United States Patent [19]

Burns

[11] Patent Number: 4,826,075

[45] Date of Patent: May 2, 1989

[54] SWINGING MAIL CATCHER

[76] Inventor: Donald S. Burns, 369 San Miguel Dr., Suite 250, Newport Beach, Calif. 92660

[21] Appl. No.: 252,555

[22] Filed: Sep. 30, 1988

[51] Int. Cl.[4] ..... A47F 5/08

[52] U.S. Cl. ..... 232/19; 211/88

[58] Field of Search ..... 232/19, 20, 21; 211/88

[56] References Cited

U.S. PATENT DOCUMENTS

| | | | |
|---|---|---|---|
| 359,458 | 3/1887 | Moore | 232/19 |
| 782,229 | 2/1905 | Field | 232/19 |
| 894,376 | 7/1908 | Field | 232/19 |
| 1,640,153 | 8/1927 | Kolstad | 232/19 |
| 1,756,559 | 4/1930 | Knapp | 232/19 X |
| 1,805,393 | 5/1931 | Fanchier | 232/20 |

*Primary Examiner*—Robert W. Gibson, Jr.

[57] ABSTRACT

The invention relates to receptacles for the collection of mail and more specifically to the collection of mail through a mail slot. According to the invention there is provided a mail receptacle means assembly consisting of a rectangular open weave basket with open top and having means for mounting to a bracket fixed to a door just below a mail slot. The receptacle means is mounted in such a way that the door can be of the overhead type such as a garage door so that it can be moved from the vertical to the horizontal orientation. The mail receptacle means and its mounting are designed to allow the receptacle means to maintain its orientation such that the open top of the receptacle means faces the ceiling no matter what position the door is in. The mail receptacle means mounting is designed also to allow the receptacle means to be removed from the door for placing onto a desk or other mail sorting or collection location.

3 Claims, 1 Drawing Sheet

SWINGING MAIL CATCHER

BACKGROUND OF THE INVENTION

The invention relates to receptacles for the collection of mail and more specifically to receptacles used to catch mail inserted through a mail slot. Nearly every home and business address in the United States has some means established for the collection and temporary storage of United States mail. A common means consists of a slot mounted in a door or a front facing wall through which the mail is simply inserted and falls within onto the floor. A number of devices have been disclosed to prevent the mail from falling to the floor and to thereby assure that it is not misplaced, lost or soiled.

The patented prior art on the subject of mail receptacles which are used in conjunction with a slot through which the mail is inserted consists of a number of ingenious devices which fulfill the requirements of catching the mail, collecting it in one place and certain other functions which will become apparent in the following discussion. Examples of prior art patents include U.S. Pat. No. 359,458 to Moore in 1887, which teaches a simple hook-on type bag catcher, U.S. Pat. No. 454,298 to Shempp in 1891 which improves over Moore with a net bag such that mail can be seen without opening the bag, U.S. Pat. Nos. 732,229 and 894,376 to Field in 1905 and 1908 respectively, whereby the receptacle is a rigid open wire frame such that mail cannot be caught in the fabric, and whereby the frame collapses upon opening of the door, U.S. Pat. No. 1,482,459 to Cahan in 1922 of a rigid mail collection trough with for the removal of mail, U.S. Pat. No. 1,640,153 to Kolstad in 1924 of a mail bag which is opened by the action of lifting the outer slot cover, U.S. Pat. No. 1,756,559 to Knapp in 1930 of a combination mailbox, door knocker, house number and light, U.S. Pat. No. 3,802,620 to Ferrara in 1974 of a portable mail catching sling which can be closed, and finally U.S. Pat. No. 4,069,965 to Maddox, Jr. in 1978 of a mail slot pouch assembly having the advantages of fabric transparency and portability.

None of the prior art disclosures show a means for catching mail through a mail slot which is compatible with an overhead door such as a garage door which either swings or rolls from a vertical orientation to a horizontal orientation. It is the applicants opinion that the present invention is new in this respect.

SUMMARY OF THE INVENTION

According to the invention there is provided a mail basket assembly consisting of a rectangular open weave basket with open top and having a means for mounting to a bracket fixed to a door just below a mail slot. The basket is mounted in such a way that the door can be of the overhead type such as a garage door. The door can be moved from the vertical to the horizontal orientation. The mail basket and its mounting are designed to allow the basket to maintain its orientation such that the open top of the basket faces the ceiling no matter what position the door is in. The mail basket mounting is designed also to allow the basket to be easily removed from the door for placing onto a desk or other mail sorting or collection location.

Accordingly, the principal object of the present invention is to provide a novel mail collection means which can be used with a door that moves from the vertical to the horizontal orientation without spilling the mail.

A further object is to provide a novel mail holding means with attachment method which permits removal from its mounting on a door or wall for use as a receptacle in mail sorting or collection.

Further objects and advantages of the invention will become apparent from a consideration of the drawings and ensuing description.

DRAWING REFERENCE NUMERALS

Figure 2:
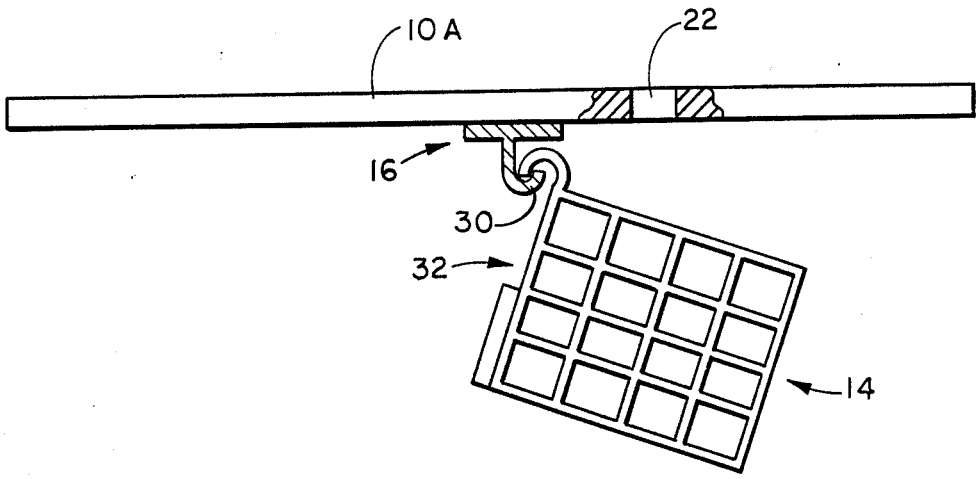
FIG. 2 is an elevation of a mail receptacle means and the door to which it is mounted. The door is shown in its horizontal orientation.

10: Door (vertical orientation)
10A: Door (horizontal orientation)
12: Mounting means
14: Mail receptacle means
16: Holding means
18: Base
20: Open weave construction
22: Slot means
24: Counterbalance weight means
26: Rectangular box
28: Downward curved elongated finger
30: Upward curved elongated finger
32: Rear wall

DESCRIPTION OF THE PREFERRED EMBODIMENT

Figure 3:
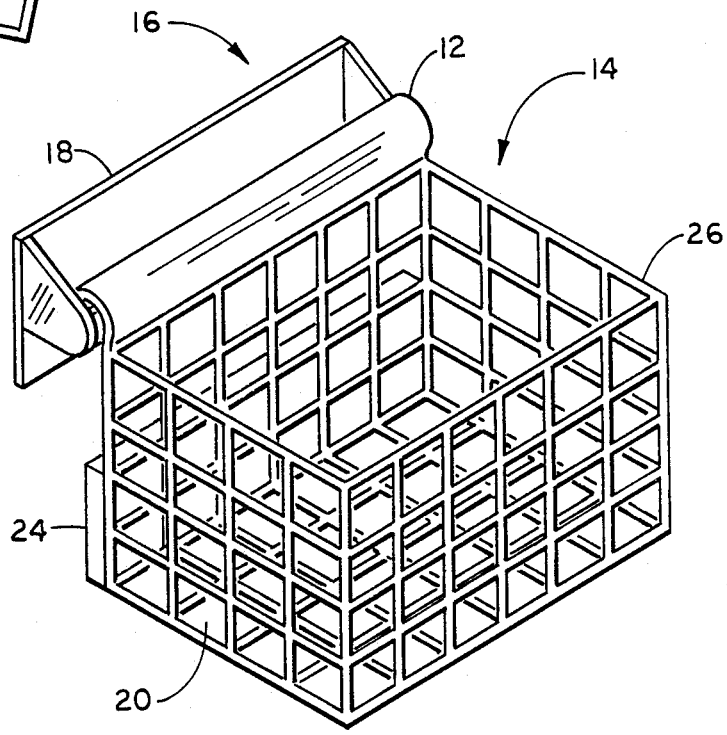
FIG. 3 is a perspective drawing of a mail receptacle means.

With reference to FIG. 3 there is shown mail receptacle means 14 consisting of a rectangular box 26 made of rigid wire formed with an open weave construction 20. Rectangular box 26 has five closed sides and an open top. Mounting means 12 is attached to rectangular box 26 along the top edge of the rear wall 32. Counterbalance weight 24 is fixed to rear wall 32.

Figure 1:
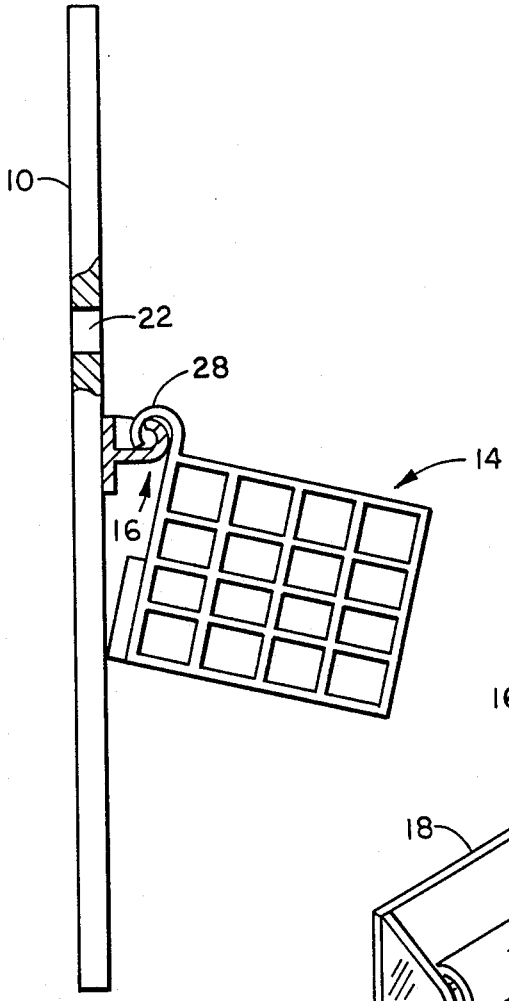
FIG. 1 is an elevation of a mail receptacle means and the door to which it is mounted. The door is shown in its vertical orientation.

With reference to FIG. 1 there is shown door 10 having mail slot 22 which is cut through door 10. Door 10 is shown in the vertical orientation. Just below mail slot 22 is holding means 16 which is fixed to door 10. Mail receptacle means 14 is hung onto holding means 16 using mounting means 12. When mounted onto door 10, mail receptacle means 14 assumes a position whereby its open top faces upward.

With reference to FIG. 2 there is shown door 10 in the horizontal orientation with mail receptacle means 14 positioned in holding means 16.

OPERATION OF THE INVENTION

When door 10 is in its vertical orientation mail may be inserted through mail slot 22 and will fall into mail receptacle means 14. Because mail receptacle means 14 has a closed construction except for its open top, mail is captured and held in place until it is removed. Because of the open weave construction of rectangular box 26, it is possible to see if there is mail within box 26 without approaching mail receptacle means 14 and without having to look into box 26 through its open top. The method of joining mounting means 12 and holding means 16 permit easy removal of mail receptacle means 14 from door 10 so that mail receptacle means 14 can be used to transport the mail to a sorting or distribution desk.

Counterbalance weight 24 provides a counterclockwise rotating force to mail receptacle means 14 which tends to keep its open top facing toward the ceiling and thus prevents mail from spilling out when door 10 is moved from the vertical to the horizontal orientation.

Having thus described my invention what I claim as new, useful and non-obvious and, accordingly secure by Letters Patent of the United States is:

1. In a door which assumes the vertical orientation when closed but may also be positioned horizontally overhead when open, the improvement of a means for catching mail comprising:

(a) slot means in said door, said slot dimensions and location conforming to the requirements of the United States Mail codes, (b) holding means fixed to said door below said slot means, (c) mail receptacle means comprising:

(i) an open weave rectangular box with closed rear wall, front wall, side walls and bottom but with an open top, (ii) mounting means fixed on said rear wall, (iii) counterbalance weight means fixed on said rear wall, whereby with said mounting means inserted into said holding means when said door is oriented vertically said mail receptacle means is oriented with said open top facing upward in an appropriate position to catch mail inserted through said slot means and provides visibility through said open weave construction of said walls to determine from a distance if mail is present within said mail receptacle means, and when said door is oriented horizontally said mail receptacle means maintains orientation with said open top facing upward as said mounting means is free to rotate within said holding means wherein rotation is assured by said counterbalance weight.

2. The means for catching mail according to claim 1 whereby said holding means and said mounting means are disengaged simply by lifting said mail receptacle means vertically whereby said mail receptacle means is easily transported for mail collection or sorting.

3. In a door which assumes the vertical orientation when closed but may also be positioned horizontally overhead when open, the improvement of a means for catching mail comprising:

(a) slot means in said door, said slot dimensions and location conforming to the requirements of the United States Mail codes, (b) holding means fixed to said door below said slot means, said holding means consisting of a upward curved elongated finger protruding from a base held fixed to said door, (c) mail receptacle means comprising:

(i) an open weave rectangular box with closed rear wall, front wall, side walls and bottom but with an open top, (ii) mounting means fixed on said rear wall of said open weave rectangular box and extending across said rear wall from one said side wall to the other said side wall, said mounting means consisting of a downward curved elongated finger protruding rearwards from said rear wall, (iii) counterbalance weight means fixed on said rear wall, below said mounting means, whereby with said mounting means inserted into said holding means when said door is oriented vertically said mail receptacle means is oriented with said open top facing upward in an appropriate position to catch mail inserted through said slot means and provides visibility through said open weave construction of said walls to determine from a distance if mail is present within said mail receptacle means, and when said door is oriented horizontally said mail receptacle means maintains orientation with said open top facing upward as said mounting means is free to rotate within said holding means wherein rotation is assured by said counterbalance weight.

* * * * *